US005084956A

United States Patent [19]

Saito et al.

[11] Patent Number: 5,084,956

[45] Date of Patent: Feb. 4, 1992

[54] METHOD OF MAKING AN OIL DASHPOT IN AN ELECTROMAGNETIC TRIPPING APPARATUS

[75] Inventors: Shigemasa Saito; Hisashi Fujitaka, both of Kanagawa, Japan

[73] Assignee: Fuji Electric Co., Ltd., Kanagawa, Japan

[21] Appl. No.: 615,967

[22] Filed: Nov. 20, 1990

[30] Foreign Application Priority Data

Nov. 20, 1989 [JP] Japan ..... 1-301547
Nov. 20, 1989 [JP] Japan ..... 1-301548

[51] Int. Cl.[5] ..... H01F 7/16

[52] U.S. Cl. ..... 29/602.1; 228/193; 335/240

[58] Field of Search ..... 29/602.1, 607; 228/193, 228/196, 197; 335/240

[56] References Cited

FOREIGN PATENT DOCUMENTS 60-15292 12/1982 Japan .
62-131346 2/1986 Japan .

*Primary Examiner*—Carl E. Hall
*Attorney, Agent, or Firm*—Finnegan, Henderson, Farabow, Garrett, and Dunner

[57] ABSTRACT

An oil dashpot and a method of producing the oil dashpot pole piece in an electromagnetic tripping apparatus from steel wire rod, wherein the steel wire rod contains phosphorus and sulfur in quantities less than 0.1 percent by weight and wherein the particle size of ferrite in a metal texture of the steel wire rod is between 7 and 8 micrometers, comprising the steps of aligning a predetermined length of steel wire rod in holding die, to form a pole piece first diameter portion and a second diameter portion. In addition, a method of producing an oil dashpot, comprising a cylinder having a body portion and a flange portion and a pole piece having a first diameter and a second diameter portion, comprising the steps of fitting the pole piece onto the cylinder such that the first diameter portion is placed within an opening in the body portion of the cylinder and the second diameter portion abuts the flange portion of the cylinder to form a junction, pressing the pole piece against the cylinder such that a predetermined force is applied to the junction between the second diameter portion and the flange portion, heating the junction by a predetermined temperature such that interdiffusion occurs between the second diameter portion and the flange portion, whereby the cylinder is sealed.

8 Claims, 5 Drawing Sheets 14
11
10
16
13
12
14
15
15
9
9a
9b
13
10

METHOD OF MAKING AN OIL DASHPOT IN AN ELECTROMAGNETIC TRIPPING APPARATUS

BACKGROUND OF THE INVENTION

1. Field of the Invention

The present invention relates to an oil dashpot and a method of producing the oil dashpot for use in the electromagnetic tripping apparatus of a circuit breaker, such as for example, a molded-case circuit breaker.

2. Description of the related Art

FIG. 7 is a longitudinal sectional view showing the configuration of a conventional electromagnetic tripping apparatus having an oil dashpot. In the drawing, the reference numeral 1 designates an L-shaped yoke; 2, an armature rotatably supported on one leg of the L-shaped yoke 2; 3, a return spring for holding the armature 2 in an illustrated position; 4, an oil dashpot fixed on the other leg of the yoke 1; and 5, a tripping coil provided so as to surround the oil dashpot 4 and connected to an electrical current path of a circuit breaker (not shown).

The oil dashpot 4 is constituted by a cylinder 6 of a non-magnetic material, such as a copper alloy, and a plunger 7 of a magnetic material provided within the cylinder 6. Cylinder 6 is filled with oil, such as for example silicone oil, which acts as a brake to motion of plunger 7 within the cylinder. Compression spring 8 urges the plunger 7 against a bottom portion of the cylinder 6, and a pole piece 9 of a magnetic material seals an open top portion of the cylinder 6. A flange 6*a* is integrally formed at the open top portion of the cylinder 6. The pole piece 9 has a large diameter portion 9*a* which contacts with the flange 6*a* and a small diameter portion 9*b* which fits into a body portion 6*b* of the cylinder 6. Pole piece 9 and cylinder 6 are typically joined by soldering or resistance welding the large diameter portion 9*a* to the flange 6*a*.

In such a configuration, when a current having at least a rated value flows into the tripping coil 5, the plunger 7 is gradually attracted toward the pole piece 9 by a resulting electromagnetic force. The compression spring 8 opposes the movement of plunger 7 towards the pole piece 9. When the plunger 7 abuts on the pole piece 9, the magnetic reluctance of a magnetic circuit constituted by the yoke 1, the armature 2, the pole piece 9, and the plunger 7 is reduced such that the armature 2 is attracted toward the pole piece 9. The armature 2 acts on a tripping mechanism (not shown) which trips a circuit breaker. The movement to plunger 7 receives a braking force form the silicone oil within the cylinder 6. This braking effect establishes a delay period between the time current flows through tripping coil 5 and the time the circuit breaker is tripped. Once the circuit breaker is tripped, the plunger 7 gradually separates from the pole piece 9 in response to the force of the compression spring 8 and returns to the state illustrated in FIG. 7.

The pole piece 9 in the conventional oil dashpot 4 is produced by cutting one end of a metal rod having a diameter equal to the large diameter portion 9*a* down to the small-diameter portion 9*b*. The metal rod used to produce the pole piece 9 is typically a machinable steel having a good cutting efficiency. Accordingly, elements such as sulfur (S), lead (Pb), and the like are added to the machinable steel to reduce the ductility of the material and to thereby improve the machining property of the steel rod. However, since these elements are distributed fibrously in the longitudinal direction of the steel rod, the rod generally lacks strength against a longitudinal exerted external force.

Therefore, the conventional pole piece 9 produced from machinable steel may fracture if a sufficiently great force acts longitudinally on the pole piece 9. Unfortunately, during the process of inserting the pole piece 9 to seal the cylinder 6 may exert just such a longitudinal force on pole piece 9. A possible result being the formation of a fracture in the root portion of the small-diameter portion 9*b*. As a result, a fractured pole piece 9 may allow silicon oil to leak from the cylinder. Of further note, the process of cutting the rod down to the small diameter portion 9*b* requires a large number of steps and is therefore very costly.

A similar problem exists in the case where an annular welding protrusion is formed on the large diameter portion 9*a* in order to improve the joining property of the pole piece 9 when it is resistance-welded to the cylinder 6. (See Japanese Utility Model Post-Examination Publication No. Sho-60-15292.) A fracture may be generated in the root portion of the small diameter portion 9*b* in the same manner as in the previous case when the welding protrusion is deformed and melted during the welding process.

Conventional techniques of joining the pole piece 9 and the cylinder 6, compress various soldering methods for soldering the periphery of the large diameter portion 9*a* to the flange 6*a* of the cylinder. These methods generally address the problem of faulty sealing as a result of uneven imperfections or pinholes in the two joined surfaces. For example, a method has been proposed wherein cylinder 6 is solder-plated and pole piece 9 is heated while being urged against cylinder 6 in order to join the pole piece 9 to the cylinder 6. (See Japanese Utility Model Unexamined Publication No. Sho-62-131346.) This method, however, creates further problems. For example, during the heating process the melted solder may migrate along the inner wall of cylinder 6 and mix with the silicone oil. Such a mixture would change the response delay the oil provides for the plunger and thereby change the time constant for the electromagnetic tripping mechanism.

Another conventional technique used to join the pole piece 9 with the large diameter portion 6*a* of the cylinder is the method of resistance-welding. This method often causes expulsion and surface flush while a welding protrusion is melted. In turn, these effects create a gap in the junction between the two joined surfaces and allow silicone oil to leak.

SUMMARY OF THE INVENTION

The present invention has been made in view of the above circumstances and has as an object to provide a method of producing an oil dashpot in which oil leakage due to a fracture in a pole piece is prevented.

A further object of the present invention is to reduce production costs associated with the fabrication of the pole piece.

Another object of the present invention is to provide a method of producing an oil dashpot in which a pole piece is joined to a cylinder without using solder.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purposes of the invention, as embodied and broadly described herein, a method of producing an oil dashpot pole piece from steel wire rod, wherein the steel wire rod contains phosphorus and sulfur in quantities less than 0.1 percent by weight and wherein the particle size of ferrite in a metal texture of the steel wire rod is between 7 and 8 micrometers, comprising the steps of aligning a predetermined length of steel wire rod in holding die, swaging the length of steel wire rod in the holding die to form a first diameter portion and a second diameter portion. Additionally, a method of producing an oil dashpot comprising a cylinder having a body portion and a flange portion and a pole piece having a first diameter and a second diameter portion, comprising the steps of fitting the pole piece onto the cylinder such that the first diameter portion is placed within an opening in the body portion of the cylinder and the second diameter portion abuts the flange portion of the cylinder to form a junction, pressing the pole piece against the cylinder such that a predetermined force is applied to the junction between the second diameter portion and the flange portion, heating the junction by a predetermined temperature such that interdiffusion occurs between the second diameter portion and the flange portion, whereby the cylinder is sealed.

BRIEF DESCRIPTION OF THE DRAWINGS

The accompanying drawings, which are incorporated in and constitute a part of this specification illustrate embodiments of the present invention and, together with the description, serve to explain the objects, advantages and principles of the invention. In the drawings.

DETAILED DESCRIPTION OF THE PREFERRED EMBODIMENTS

Embodiments of the present invention will be described with reference to the accompanying drawings. Portions corresponding to those of the prior art are referenced accordingly.

Figure 1:
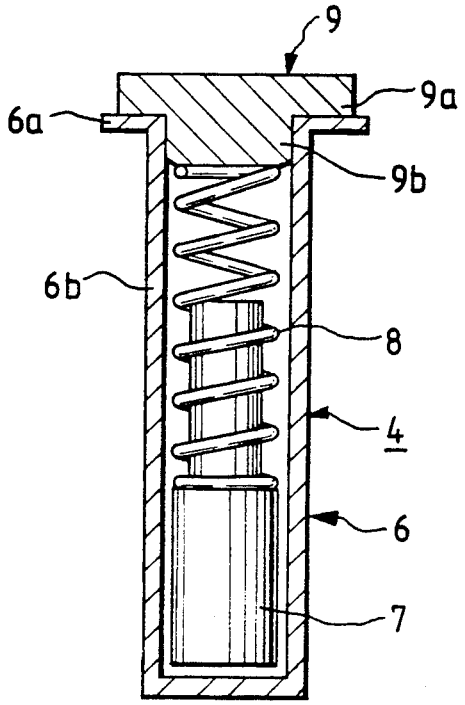
FIG. 1 is a longitudinal sectional view showing an embodiment of the oil dashpot produced by the method according to the present invention.

FIG. 1 is a longitudinal sectional view showing the oil dashpot 4 according to the present invention. In the drawing, a plunger 7, a compression spring 8, and silicon oil are provided within a cylinder 6. The cylinder 6 is formed from brass through a drawing process. The opening portion of the cylinder 6 is sealed with a pole piece 9 comprising a large-diameter portion 9*a* which contacts with a flange 6*a* of the cylinder 6 and a small-diameter portion 9*b* which fits into a body portion 6*b* of the cylinder 6. The pole piece 9 is formed through a swaging process from a mild steel wire rod wherein the content of each of phosphorus and sulfur is less than or equal to 0.1 percent by weight and wherein the particle size of ferrite in a metal texture is, for example selected to be 7 micrometers.

Figures 5A, 5B, 5C, 5D:
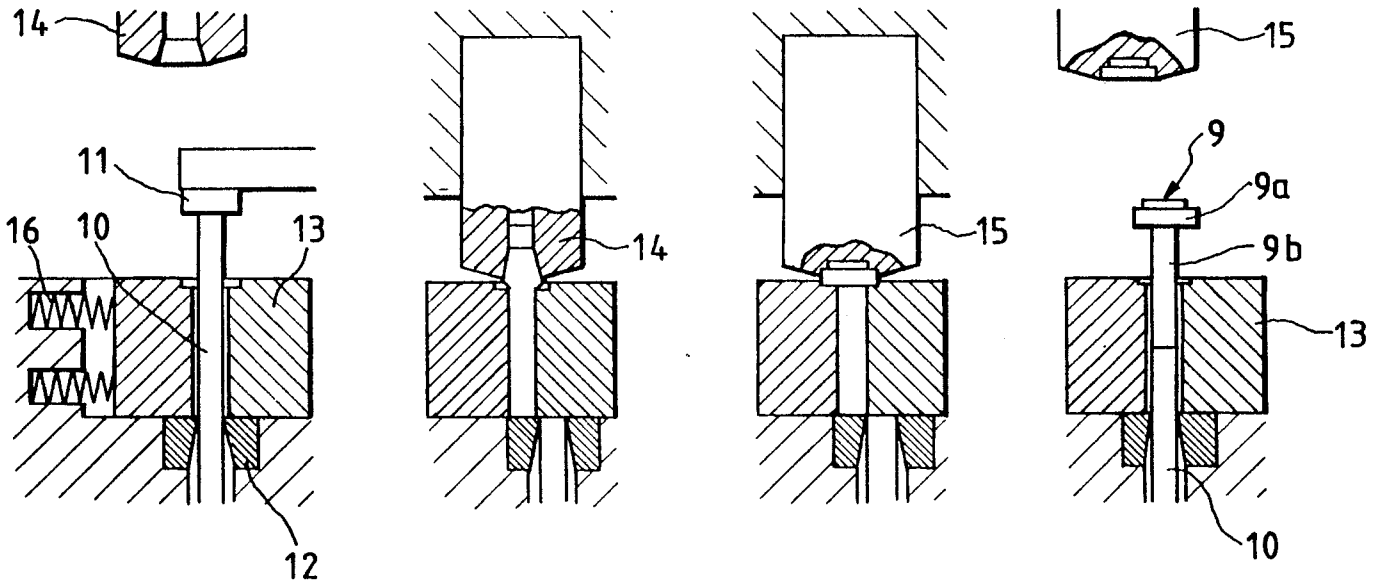
FIGS. 5(A)–5(D) show schematic process views explaining the steps of swaging working of the pole piece of FIG. 1.

The pole piece 9 is formed by means of a swaging machine through the steps shown in FIG. 5. In FIG. 5, diagram (A) shows a material introducing step; diagram (B) shows a cutting and pre-swaging step, diagram (C) shows a finishing swaging step; and diagram (D) shows a pushing-out step. In the drawings, reference numeral 10 designates a wire rod; 11, a fixed-length stopper; 12, a cutting dies; 13, a small-diameter portion forming dies; 14, a large-diameter portion pre-swaging punch; and 15, a large-diameter portion finishing swaging punch.

In diagram (A) of FIG. 5, the wire rod 10 is introduced from below so as to abut the fixed-length stopper 11. The small diameter portion forming dies 13 then slides left in the drawing against springs 16, so that the wire rod 10 is sheared between the small-diameter portion forming dies 13 and the cutting dies 12 to produce a pole piece of fixed length. Next, as shown in diagram (B) of FIG. 5, the large-diameter pre-swaging punch 14 descends to thereby pre-swage a portion of the fixed length which will become the large-diameter portion 9*a*. At this time, the wire rod 10 is expanded in the small-diameter portion forming dies 13 to the inner diameter thereof so as to be formed into the small-diameter portion 9*b*. Then, as shown in diagram (C) of FIG. 5, the large-diameter portion finishing pre-swaging punch 15 descends to thereby finishing-swage the large-diameter portion 9*a*. Finally, as shown in diagram (D) of FIG. 5, the formed pole piece 9 is pushed up by the wire rod 10 to thereby be discharged from the dies 13.

The pole piece is accordingly formed, by swaging the large-diameter portion, from a mild steel wire rod having a diameter corresponding to that of the small-diameter portion. As a result, metal fibers continue between the large-diameter and small-diameter portions. Such continuity in the metal fibers also occurs between a welding protrusion and a flat surface portion when a welding protrusion is formed on the large-diameter portion of the pole piece. Furthermore, since the metal fibers are deformed at right angles with respect to the pressure exerted when the pole piece is inserted into the cylinder and at the time of welding, there is less likelihood of a fracture developing in the pole piece. Finally, the cost of producing the pole piece by the swaging process are lower than the cost of producing the pole piece by the cutting process because high-speed processing can be continuously performed by the swaging process.

The mild steel wire rod used in the swaging process will contain an extremely low content of phosphorus and sulfur. The content of phosphorus and sulfur is in each case less than or equal to 0.1 percent by weight. Accordingly, the possibility of fracturing the small diameter portion of the pole piece is reduced.

Ferrite crystals in the mild steel rod will be uniformly fine particles having a particle size in the range of 7–8 micrometers. This relatively large particle size provides several benefits. For example, in metal with a ferrite particle size of 6 or 5 micrometers, a possibility exists that the quantity of deformation of crystal particles constituting a connection portion between the large and small-diameter portions will reduce the mechanical strength of the boundary portion. That is the boundary between rectangular crystal particles in the small-diameter portion and deformed flat crystal particles in the large-diameter portion may be weakened such that the connector may be fractured at this boundary when the pole piece is inserted into the cylinder of when annular protrusion welding is performed.

Figure 6:
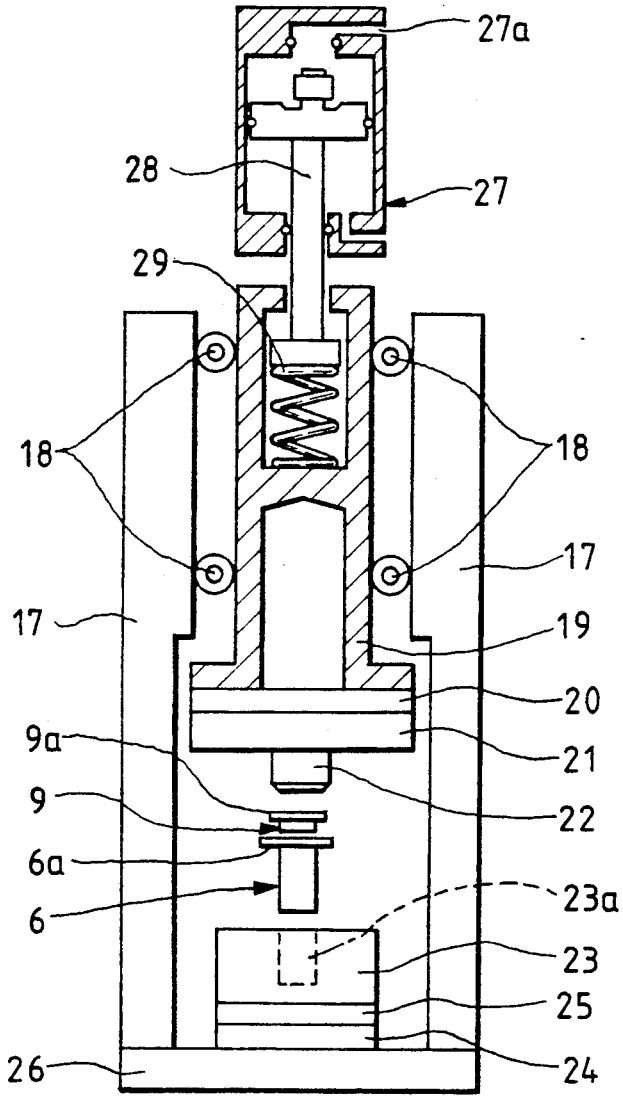
FIG. 6 is a partially sectional front view showing an apparatus used to produce the junction between the pole piece and the cylinder in FIG. 1.
Figure 7:
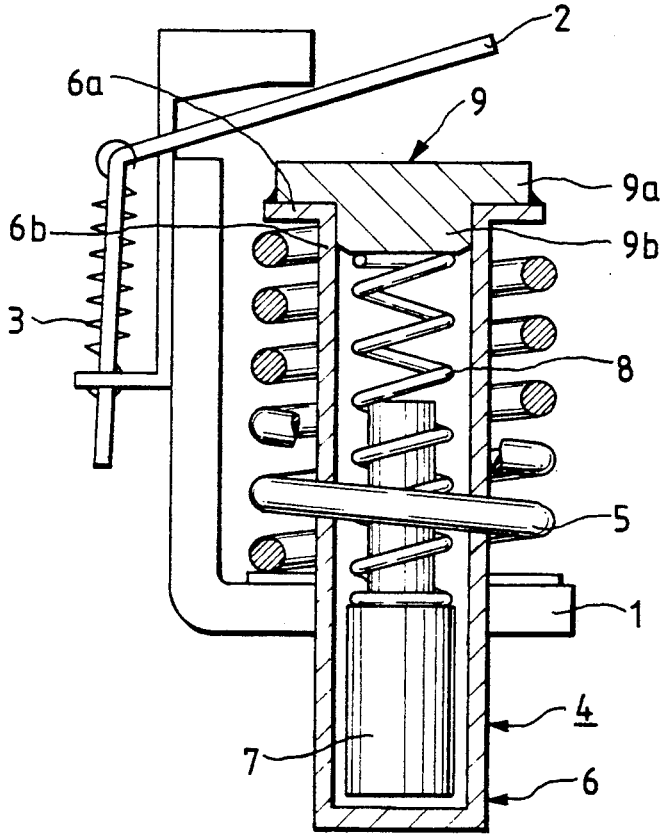
FIG. 7 is a longitudinal sectional view showing the general configuration of an electromagnetic tripping apparatus.

In the following example, it is assumed that the whole surface of the pole piece 9 is plated with copper, and that the pole piece is to be solid-phase joined with the cylinder 6 through an interdiffusion process. Referring to FIG. 6, this solid-phase joining process will be described.

In FIG. 6, an upper electrode 22 of a copper alloy is provided, through an insulation 20 and a conductor 21, on a ram 19 having a polygonal shape in section and vertically movably supported on frames 17 through rollers 18. Coaxially provided below this assembly is a lower electrode 23 made of a copper alloy similarly to the upper electrode 22 is supported on a base 26 through an insulation 24 and a conductor 25. The ram 19 is driven by an air cylinder 27, and a compression spring 29 is interposed between a piston rod 28 and the ram 19. A hole 23*a* to receive the body portion 6*b* of the cylinder 6 is formed in the lower electrode 23.

Then, the body portion 6*b* of the cylinder 4 is inserted into hole 23*a* of the lower electrode 23, and the small-diameter portion 9*b* of pole piece 9 is inserted into the cylinder body portion 6*b*. Compressed air is sent from an air inlet 27*a* of air cylinder 27 to thereby press the large-diameter portion 9*a* of the pole piece 9 against the flange 6*a* of the cylinder 6 at pressure in the range of 4.5–5.5 kgf/mm$_2$. At the same time, an alternating current is caused to flow between conductors 21 and 25 through the lead wires (not shown) for a predetermined time such that a contact portion between the large-diameter portion 9*a* and the flange 6*a* is heated by heat in the range of 700° C.–850° C. Accordingly, interdiffusion occurs at the junction interface between the copper in the plating layer of the pole piece 9 and the copper and zinc which are principal component of the cylinder 6. As a result, the large-diameter portion 9*a* and the flange 6*a* are joined together without being melted. The compression spring 29 serves to prevent generation of expulsion and surface flush due to reduction of the pressing force when the interdiffusion process occurs and the junction portion softens because of the resulting temperature rise.

The foregoing pressure and heating temperature are adjusted within the described respective ranges by adjusting the current value and the current conduction time respectively. As an example, in an experiment using the apparatus of FIG. 6, when the pressing force, the current value and the current conduction time were selected to be 180 kg, about 13 kA, and 10 cycles (or 1/6 of a second using a conventional 60 Hz device), the pressure and heating temperature in the foregoing ranges were obtained.

In contrast, if the pole piece 9 is soldered to the cylinder 6, for example, by high-frequency heating, a heating time of about 10 seconds is required. This process, however, raises the temperature of the junction portion by about 250° C., and the oil temperature in the inside of the cylinder by about 80° C. As a result, during the heating process silicone oil sometimes leaks from the junction portion because of expansion of heated gas within the cylinder 6. By comparison, the use of the solid-phase joining process requires a heating time which is relatively very short, that is about 10 cycles or 1/6 sec. assuming a commercial power source of 60 Hz. Accordingly, while the temperature of the junction portion is high, the oil temperature does not significantly increase such that there is no possibility the oil leaking as in the soldering process.

In summary, the cylinder and the pole piece are pressed together while being heated in the atmosphere or in an atmospheric gas so that a junction is formed through interdiffusion between the large diameter portion of the pole piece and flange portion of the cylinder. The pressure is necessary to provide plastic deformation of the uneven portions of the junction surface. The pressure facilitates the interdiffusion process by bringing the surface atoms to be fused inclose proximity to one another. Further, the heating is necessary for the interdiffusion between the atoms of the material surfaces at a temperature not higher the solid-phase level.

The pole piece is generally plated with copper (Cu) for the purpose of rust prevention, and the cylinder is typically formed of brass (copper and zinc (Zn)). Since the diffusion property between copper and copper or copper and zinc is extremely good, such a combination between the pole piece and cylinder is very desirable when the foregoing solid-phase junction is formed.

However, copper is apt to be covered with an oxide coating and the oxide coating effectively prevents interdiffusion. Silver, on the other hand, does not significantly oxidized and the diffusion property between silver and copper or silver and zinc is also excellent. Therefore, if copper plating is performed as the under plating, and the silver plating is further performed on the copper plating, the reliability of the junction is further increased. The silver plating is advantageous in reduction of the temperature required for the interdiffusion. Nickel (NI) plating may be performed in place of silver plating.

In making such a solid-phase junction, the pole piece and the cylinder are combined with each other and forced together while being heated in the atmosphere or in an atmospheric gas. At that time, it is preferable that the combination of the pole piece and the cylinder are sandwiched between upper and lower electrodes of an ordinary resistance welding machine and forced together while being heated by current conduction. As the electrode material, a copper alloy, carbon, molybdenum, or the like is used.

It is necessary to suitably select the pressure and the heating temperature so as to obtain a strong junction. When the pole piece plated with copper and the cylinder of brass are joined with each other, it is preferable that the pressure is selected to be 4.5–5.5 kgf/mm$^2$ and the heating temperature is selected to be 700°–850° C. Also in the case where the pole piece is plated with nickel, the same conditions are sufficient. When the pole piece is plated with silver, on the other hand, it is preferable that the pressure is selected to be 3.0–4.0 kgf/mm$^2$ and the heating temperature is selected to be 650°–750° C.

In any case, a junction having a higher sealing property can be obtained when an annular protrusion is provided on a junction surface of either the pole piece or the cylinder.

Copper plating of the pole piece performs a rust preventing function and a joining function due to excellent interdiffusion properties between the copper of the plating and the zinc contained in the cylinder.

In the case where the pole piece plated with copper, silver, or nickel and the cylinder of brass are joined with each other while being heated by current conduction, if the pressure is smaller than 4.5 $kgf/mm_2$ (in the case of copper or nickel plating) or 4 $kgf/mm_2$ (in the case of silver plating), expulsion and surface flush or sputter is generated between the junction surfaces or between the pole piece/cylinder and electrodes. If the pressure exceeds 5.5 $kgf/mm_2$ (in the case of copper or nickel plating) or 4 $kgf/mm_2$ (in the case of silver plating), on the contrary, a fracture is generated in the flange of the cylinder or in the large-diameter portion of the pole piece.

If the heating temperature is lower than 700° C. (in the case of copper or nickel plating) or 650° C. (in the case of silver plating), the joining is insufficient so that an oxide coating is generated on the interface of the junction. If the heating temperature exceeds 850 in (in the case of copper or nickel plating) or 750 in (in the case of silver plating), on the contrary, a fracture is generated in the flange of the cylinder or in the large-diameter portion of the pole piece, or expulsion and surface flush or a molten layer observed by a resistance welding method is generated to cause a possibility of occurrence of oil leakage. Further, zinc which is a principal component of the cylinder precipitates to make the junction portion fragile.

Figure 2:
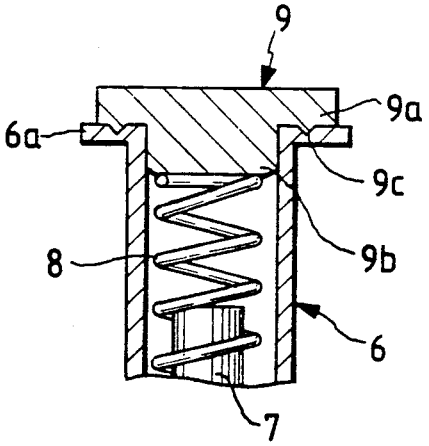
FIG. 2 is a longitudinal sectional view showing main parts of a second embodiment.
Figure 3:
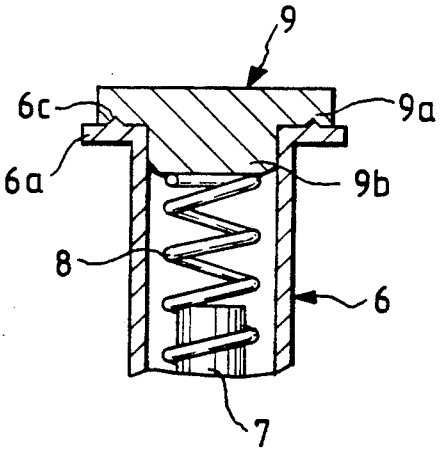
FIG. 3 is a longitudinal sectional view showing main parts of a third embodiment.

An annular protrusion on the junction surface of the pole piece or the cylinder serves to plasmically deform the junction surface to thereby remove an adhering alien substance or an adhering oxide coating so as to further improve the joining property. FIG. 2 shows a second embodiment of the present invention in which an annular protrusion 9*c* is formed on a junction surface of a pole piece 9. FIG. 3 shows a third embodiment of the present invention in which an annular protrusion 6*c* is formed on a junction surface of a cylinder 6. Each of the protrusion 9*c* and 6*c* plasmically deforms under the pressing force of the ram so as to remove any alien substance or oxide coating on the junction surface to thereby improve the joining property.

Figure 4A:
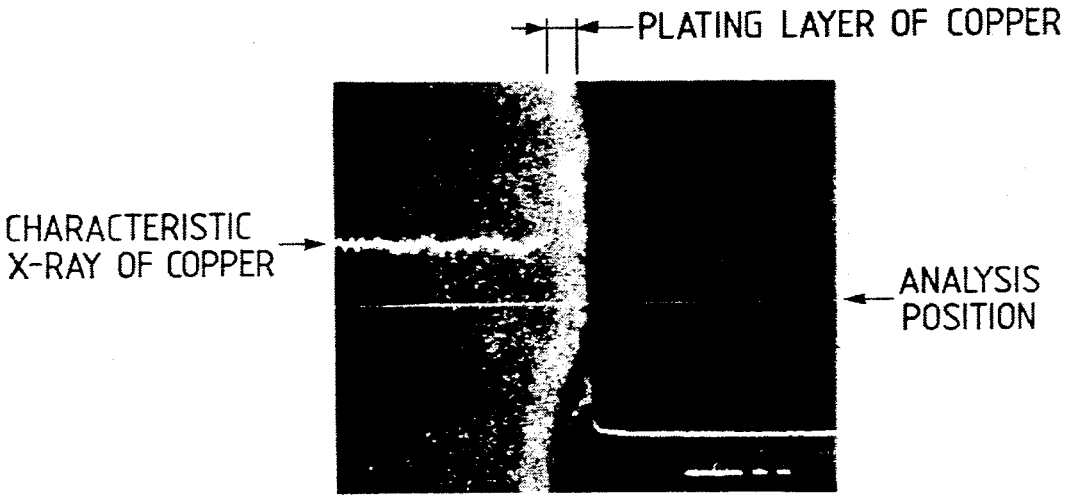
FIG. 4(A) is a characteristic X-ray analysis photograph of copper in the junction portion between the pole piece and the cylinder of FIG. 1.
Figure 4B:
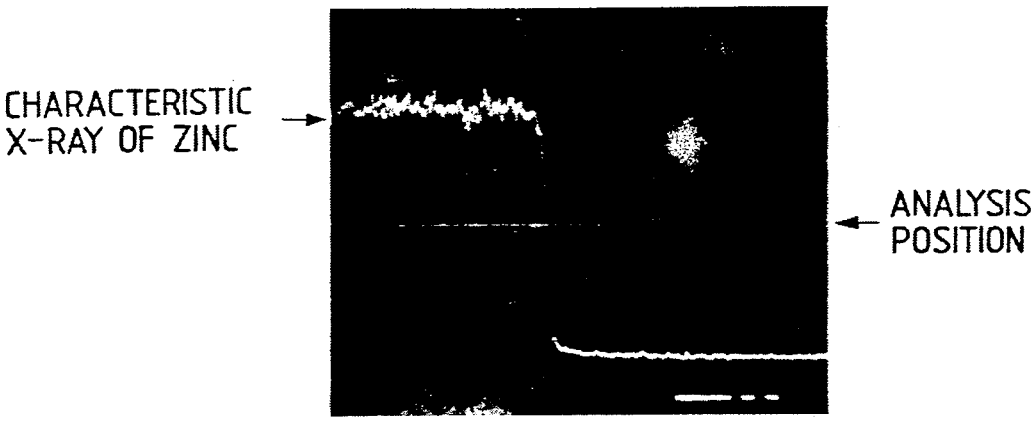
FIG. 4(B) is a characteristic X-ray analysis photograph of zinc similar to FIG. 4(A)

FIG. 4 shows sectional photographs (magnification X 600) showing the results of characteristic X-ray elementary analysis (EPMA) of principal components constituting the junction portion between the large-diameter portion 9*a* of the pole piece 9 and the flange 6*a* of the cylinder 6 formed in a manner described above. The right and left portions of the photograph show the large-diameter portion 9*a* of the pole piece 9 and the flange 6*a* of the cylinder 6 respectively. Photographs (A) and (B) of FIG. 4 show the results o EPMA of copper and zinc respectively. As shown in the photograph (A) of FIG. 4, the quantity of copper continuously changed at a junction interface such that the interdiffusion occurred between the copper in the plating layer of the pole piece 9 and the copper contained in the cylinder 6 to thereby form a solid-phase junction. On the other hand, as shown in the photograph (B) of FIG. 4, the quantity of zinc continuously changed at a junction interface such that interdiffusion occurred between the copper in the plating layer of the pole piece 9 and the zinc in the cylinder 6.

According to the present invention, the pole piece is produced by a swaging process such that no oil leaks from the cylinder due to a fracture in the pole piece. The swaging process also requires fewer steps to produce the pole piece and is, accordingly, less expensive. Furthermore, the pole piece and the cylinder are joined to each other through a solid-phase junction. As such defective sealing due to pinholes or expulsion and surface flush are reduced. A change of the delay contact characteristic of the electromagnetic tripping mechanism due to an inflow of fuse solder to the oil is likewise prevented.

Recently, an oil dashpot in which a cylinder is not filled with oil has been proposed. However, many of the advantages previously recited will also apply to this case.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method of producing an oil dashpot in an electromagnetic tripping apparatus comprising a cylinder having a body portion and a flange portion and a pole piece having a first diameter and a second diameter portion, comprising the steps:

fitting the pole piece onto the cylinder such that the first diameter portion is placed within an opening in the body portion of the cylinder and the second diameter portion abuts the flange portion of the cylinder to form a junction;

pressing the pole piece against the cylinder such that a predetermined force is applied to the junction between the second diameter portion and the flange portion;

heating the junction by a predetermined temperature such that interdiffusion occurs between the second diameter portion and the flange portion, whereby the cylinder is sealed.

2. A method of producing an oil dashpot in an electromagnetic tripping apparatus, according to claim 1, further comprising the step of forming an annular protrusion on the flange portion of the cylinder.

3. A method of producing an oil dashpot in an electromagnetic tripping apparatus, according to claim 1, wherein the pole piece is plated with copper and the cylinder is made of brass and wherein the predetermined force is in a range of 4.5–5.5 $kgf/mm^2$ and the predetermined temperature is in a range of 700°–850° C.

4. A method of producing an oil dashpot in an electromagnetic tripping apparatus, according to claim 1, wherein the pole piece is plated with nickel and the cylinder is made of brass and wherein the predetermined force is in a range of 4.5–5.5 $kgf/mm^2$ and the predetermined temperature is in a range of 700°–850° C.

5. A method of producing an oil dashpot in an electromagnetic tripping apparatus, according to claim 1, wherein the pole piece is plated with silver and the cylinder is made of brass and wherein the predetermined force is in a range of 3.0–4.0 kgf/mm$^2$ and the predetermined temperature is in a range of 650°–750° C.

6. A method of producing an oil dashpot in an electromagnetic tripping apparatus, according to claim 2, wherein the pole piece is plated with copper and the cylinder is made of brass and wherein the predetermined force is in a range of 4.5–5.5 kgf/mm$^2$ and the predetermined temperature is in a range of 700°–850° C.

7. A method of producing an oil dashpot in an electromagnetic tripping apparatus, according to claim 2, wherein the pole piece is plated with nickel and the cylinder is made of brass and wherein the predetermined force is in a range of 4.5–5.5 kgf/mm$^2$ and the predetermined temperature is in a range of 700°–850° C.

8. A method of producing an oil dashpot in an electromagnetic tripping apparatus, according to claim 2, wherein the pole piece is plated with silver and the cylinder is made of brass and wherein the predetermined force is in a range of 3.0–4.0 kgf/mm$^2$ and the predetermined temperature is in a range of 650°–750° C.

* * * * *

UNITED STATES PATENT AND TRADEMARK OFFICE

CERTIFICATE OF CORRECTION

PATENT NO. : 5,084,956

DATED : February 04, 1992

INVENTOR(S) : Shigemasa Saito et al.

It is certified that error appears in the above-identified patent and that said Letters Patent is hereby corrected as shown below:

Abstract, line 8, after "die", insert --swage the length of steel wire rod in the holding die--.

Signed and Sealed this

Twenty-second Day of June, 1993

*Attest:*

Michael K. Kirk

MICHAEL K. KIRK

*Attesting Officer*

*Acting Commissioner of Patents and Trademarks*